United States Patent [19]

Eckert et al.

[11] Patent Number: 4,949,786

[45] Date of Patent: Aug. 21, 1990

[54] EMERGENCY CASING HANGER

[75] Inventors: Lawrence A. Eckert, Houston, Tex.; Graeme Johnston, Aberdeen, Scotland; Peter M. Kent, Scotland, United Kingdom

[73] Assignee: Vecto Gray Inc., Houston, Tex.

[21] Appl. No.: 335,996

[22] Filed: Apr. 7, 1989

[51] Int. Cl.[5] ..... E21B 23/00; E21B 33/04

[52] U.S. Cl. ..... 166/208; 166/217; 285/145

[58] Field of Search ..... 166/208, 217, 135, 181, 166/182, 124, 86, 88; 285/140, 145, 146, 147, 331, 338, 342, 343, 348, 351

[56] References Cited

U.S. PATENT DOCUMENTS 2,692,066 10/1954 Conrad ..... 285/145 X 4,750,559 6/1988 Greenlee et al. ..... 166/216

4,791,987 12/1988 Cassity et al. ..... 166/217 X 4,832,125 5/1989 Taylor ..... 166/208 X

*Primary Examiner*—William P. Neuder

*Attorney, Agent, or Firm*—James E. Bradley

[57] ABSTRACT

An emergency casing hanger and packoff allows casing to be set when it has been stuck. The hanger has a slip body that slides over the casing after the casing is cut. The slip body lands in a wellhead housing. The slip body has a bowl which carries slips for gripping the casing. A split ring carried by the body engages a recess in the wellhead housing to lock the hanger in place. A wedge moves the split ring outward when rotated by a running tool. An energizing ring carried by the slip body moves the slips downward to energize them. The packoff has a metal seal ring with an annular cavity, defining inner and outer faces. The inner face contains a plurality of deformable bands. A wedge member urges the faces apart, causing the bands to deform and seal against the casing.

6 Claims, 3 Drawing Sheets

EMERGENCY CASING HANGER

BACKGROUND OF THE INVENTION

1. Field of the Invention

This invention relates in general to wellhead equipment for oil and gas wells, and in particular to an emergency casing hanger.

2. Description of the Prior Art

In a well of the type concerned herein, a wellhead housing will normally be located on land, or on a surface platform, if offshore. The wellhead housing has a landing profile or shoulder within its bore. When running casing, the casing is lowered into the well. A casing hanger is installed on the upper end of the string of casing. This casing hanger lands on the landing shoulder in the bore of the wellhead housing.

After cementing, a packoff is positioned between the casing and the wellhead housing. This packoff locates between machined surfaces on the wellhead housing and the casing hanger.

Occasionally, the casing will not smoothly proceed to the bottom of the well. When this occurs, the casing hanger will not be properly positioned to land in the wellhead housing. Generally, when this happens, the casing cannot be retrieved to the surface and becomes stuck. In that case, the casing must be cut above the landing shoulder after cementing. In the prior art technique, the assembly is supported by slips in the wellhead housing.

One problem with supporting a casing stub in an emergency procedure occurs because the casing will often not be centralized within the wellhead housing. The casing particularly will be off center in deviated wells. Conventional slips, which move down a bowl by gravity, will not center the casing. If the casing is not centered, it will be difficult to seal the space between the casing and the wellhead housing. This is particularly a problem with metal-to-metal seals.

Another problem with sealing against a casing stub occurs because the casing does not have a smooth machined surface for receiving a packoff. The casing outer diameter has a high dimensional variation. The outer diameter may be slightly oval shaped. The surface of the casing may have many defects, such as rust, pock marks, and tong marks.

SUMMARY OF THE INVENTION

The emergency casing hanger assembly of this invention has a hanger and a packoff. The hanger has a slip body which slides around the casing and lands on the landing shoulder in the wellhead housing. The slip body has at least one bowl which encircles the casing. A plurality of slips are carried on the bowl. The wellhead housing has a groove above the landing shoulder. A split ring, carried by the slip body, locates in this groove. A wedge ring wedges the split ring into the groove to lock the casing hanger in place.

The slip body carries an energizing ring. The energizing ring moves between an upper position to a lower position, pushing the slips downward to engage the casing. An annular spring biases the slips upward. The spring and energizing ring cause the slips to move downward in unison, centralizing the casing stub.

The packoff is then lowered above the energizing ring for sealing the casing to the wellhead housing. The packoff includes a metal seal ring having an inner and an outer face. A central cavity receives an energizing wedge member to wedge the inner and outer faces outward into sealing engagement with the wellhead housing and the casing. A plurality of deformable bands are located on the inner face. These bands deform against the casing to cause sealing. The cavity has a tapered inner wall so as to cause substantial displacement inward of the inner face as the wedge member energizes the seal.

DESCRIPTION OF THE PREFERRED EMBODIMENT

Figure 1:
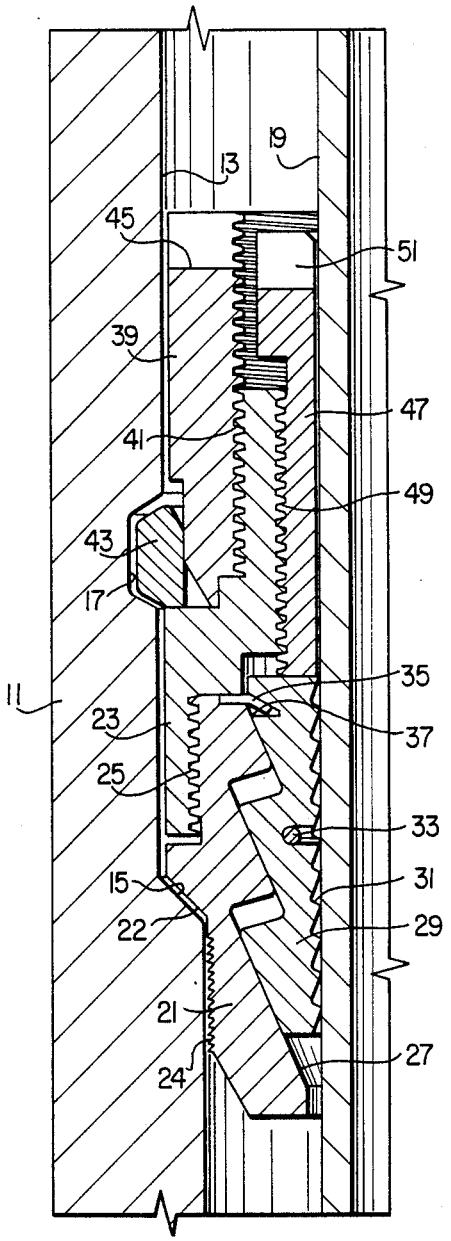
FIG. 1 is a vertical sectional view illustrating an emergency casing hanger constructed in accordance with this invention, and shown in the energized state.

Referring to FIG. 1, wellhead housing 11 will be located on the surface. It has a bore 13 which contains a landing shoulder 15. The landing shoulder 15 is frusto-conical. A circumferential recess or groove 17 is located in bore 13 a short distance above the landing shoulder 15. Casing 19 extends through the wellhead housing 11 and into the well.

The casing 19 in this case is casing that has stuck in the well. It will be cemented in place and cut off at the wellhead housing 11. It will then be supported by an emergency casing hanger. The emergency casing hanger includes a body 21. Body 21 is tubular, and has an exterior shoulder 22 which lands on the landing shoulder 15 in the wellhead housing 11. The body 21 includes an upper portion 23 which is secured by threads 25. A plurality of wickers or circumferential grooves 24 are located on a lower portion of the body 21, below the shoulder 22. The grooves 24 are closely spaced from the bore 13 below shoulder 15. Grooves 24 will contact the bore 13 and adhere to the bore in the event of deflection of body 21.

Body 21 has a bowl 27 inside, which in the preferred embodiment comprises three frusto-conical surfaces. The bowl 27 receives mating slips 29. The slips 29 are separate segments which are slidingly carried on the bowl 27. Each slip 29 will move from an upper position, shown in FIG. 2, to a lower engaged position shown in FIG. 1. A plurality of teeth or grooves 31 are located on the inner face of each of the slips 29 for gripping the casing 19.

The slips 29 are retained together by a retainer ring 33. Retainer ring 33 is a circular split wire or ring, which locates within a slot in each of the slips 29. The retainer ring 33 urges the slips 29 outward. Also, a spring 35 is connected between the slip body 21 and each of the slips 29. Spring 35 is an annular member, having its outer edge fixed between the junction of the slip body 21 and the upper portion 23. The inner edge locates within a slot 37 contained in the outer side of each of the slips 29.

Figure 2:
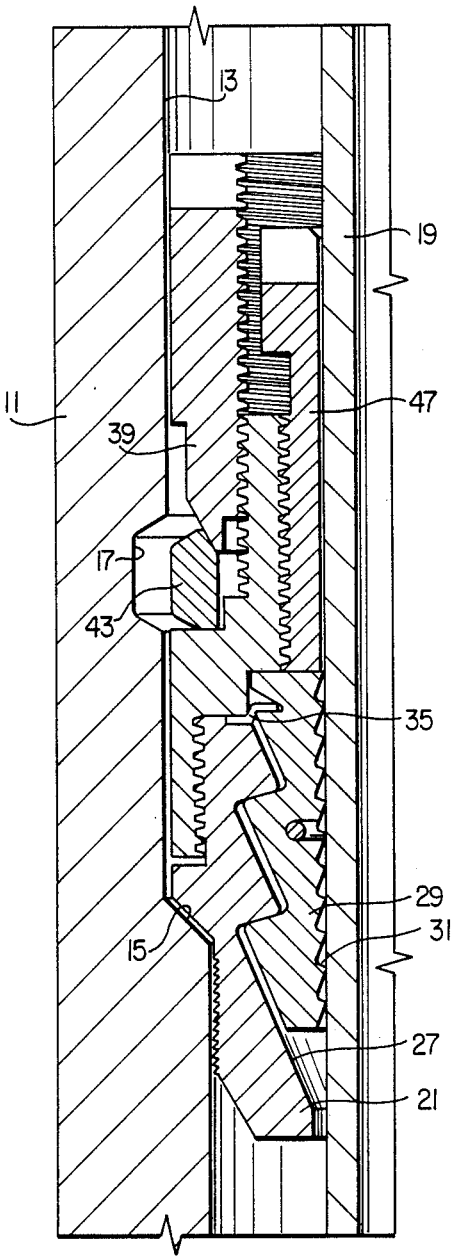
FIG. 2 is a sectional view of the casing hanger of FIG. 1, shown in the unenergized condition, landing on the wellhead housing landing shoulder.

In the natural state, as shown in FIG. 2, the spring 35 assumes a configuration wherein the inner edge and the slot 37 will be located above the portion of the spring 35 that secures to the body 21. Spring 35 deflects downward, as shown in FIG. 1, when the slips 29 are moved to the engaged position. The spring 35 serves as means for urging these slips 29 upward. Spring 35 also causes the slips 29 to move downward in unison.

A wedge ring 39 is carried by the upper slip body portion 23. The wedge ring 39 has interior threads that engage exterior threads 41 located on the body upper portion 23. The wedge ring 39, when rotated, will move from an upper position, shown in FIG. 2, to a lower position shown in FIG. 1. A lower exterior surface of the wedge ring 39 pushes a locking ring 43 outward when the wedge ring 39 is moved to the lower position. The locking ring 43 is an annular split ring that is positioned on the exterior of the body upper portion 23 for engaging the groove 17 in the wellhead housing 11. The locking ring 43 and the wedge ring 39 serve as means for locking the slip body 21 to the wellhead housing 11.

A plurality of castellations 45 located on the upper end of the wedge ring 39 will receive a running tool (not shown). The castellations 45 are vertical slots that receive fingers of the running tool for causing the wedge ring 39 to rotate when the running tool is rotated.

An energizing ring 47 locates on the inner side of the slip upper body portion 23. The energizing ring 47 has threads on its exterior which engage interior threads 49 formed on this slip upper body portion 23. The energizing ring 47 has castellations 51 on its upper end for receiving fingers from a running tool (not shown). The lower end of the energizing ring 47 contacts the upper end of the slips 29. Rotating the energizing ring 47 causes it to move from the upper position shown in FIG. 2 to the lower position shown in FIG. 1.

The height and positioning of the energizing ring 47 and the wedge ring 39 are selected so that one running tool can accomplish the setting in one run. The wedge ring 39 extends up farther than the energizing ring, consequently, rotation of the running tool necessarily rotates the wedge ring 39 down to the lower position first. Then, the running tool will engage and rotate the energizing ring 47.

Figure 4:
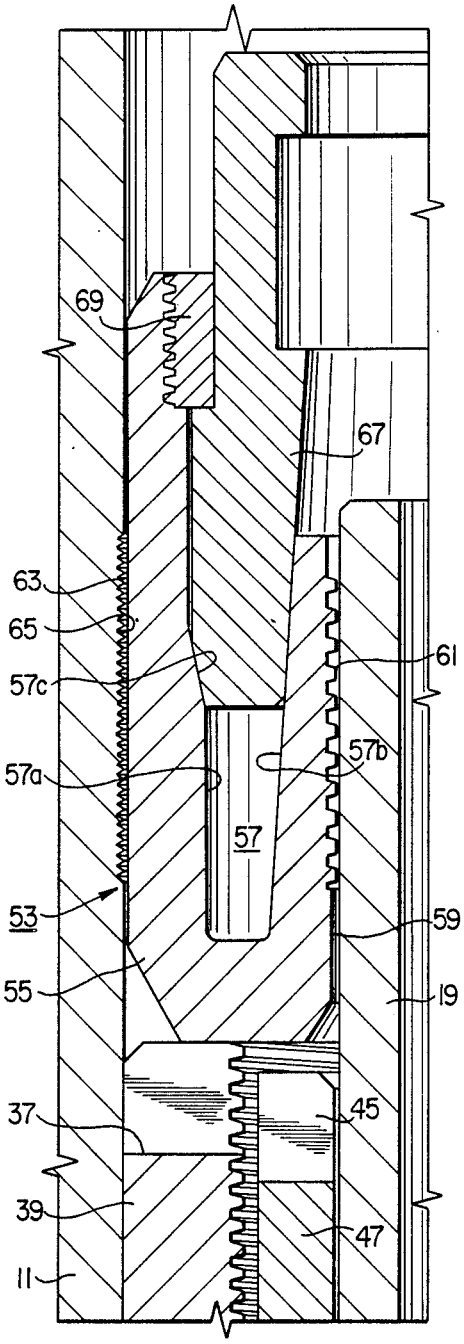
FIG. 4 is a sectional view illustrating a packoff construction in accordance with this invention, and shown in the unenergized state.

After the casing hanger has been set, a packoff 53 is lowered in place, as shown in FIG. 4. Packoff 53 includes a metal seal ring 55. Seal ring 55 has an annular central cavity 57. Cavity 57 has an outer wall 57*a* and an inner wall 57*b*. The inner wall 57*b* is tapered about 2 degrees relative to vertical. This makes the cavity 57 wider at the top than at the bottom. The outer wall 57*a* is cylindrical, and of two different inner diameters, one in its upper portion, and one in its lower portion. The upper portion is larger in diameter than the lower portion. A tapered section 57*c* joins the upper and lower portions of the outer wall 57*a*.

The seal ring 55 has an inner face 59. The inner face 59 is cylindrical. A plurality of circumferential bands 61 protrude from the inner face 59. The bands 61 are of a soft, deformable metal, much softer than the metal of the casing 19. The bands 61 may be machined on the surface of the seal ring 55. The seal ring 55 has an outer face 63 which is adapted to engage wickers 65. The wickers 65 are located in the wellhead housing 11.

The seal ring 55 is energized by an energizing wedge member 67. The wedge member 67 is annular, and is carried initially in the upper end of the cavity 57. The wedge member 67 is of a larger radial thickness than the radial extent of the cavity 57. Consequently, when the wedge member 67 moves downward, it pushes the outer face 63 outward into the wickers 65. It pushes the inner face 59 inward into the casing 19. The inner side of the wedge member 67 is tapered at the same degree of taper as the cavity inner wall 57*b*. The outer side of the wedge member 67 is cylindrical, but for a beveled section on the lower end.

Figure 5:
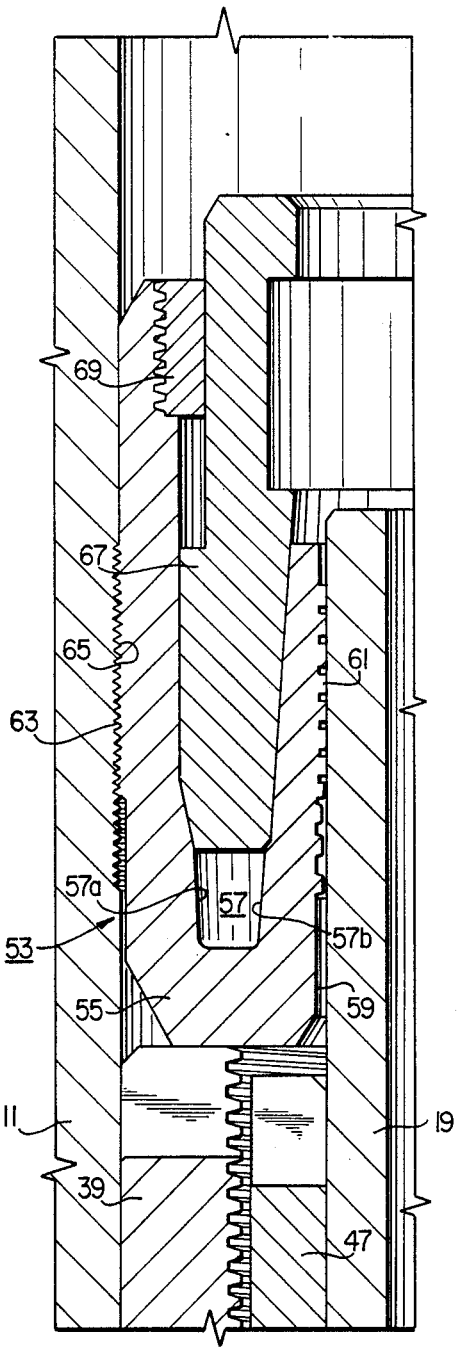
FIG. 5 is a sectional view of the packoff of FIG. 4, shown in the energized state.

A retaining collar 69 retains the wedge member 67. A running tool will move the wedge member 67 from the upper position shown in FIG. 4 to the lower position shown in FIG. 5.

In operation, if the casing 19 becomes stuck, it will be cemented in place. The casing 19 above the wellhead 11 will be disconnected and the blow-out preventer stack set aside. The slip body 21 is positioned around the casing 19 and dropped into the wellhead 11. The slip body is forced downward until its shoulder 22 engages the shoulder 15. This assists in centering the casing 19 in the wellhead housing bore 13. This will be the position shown in FIG. 2.

Figure 3:
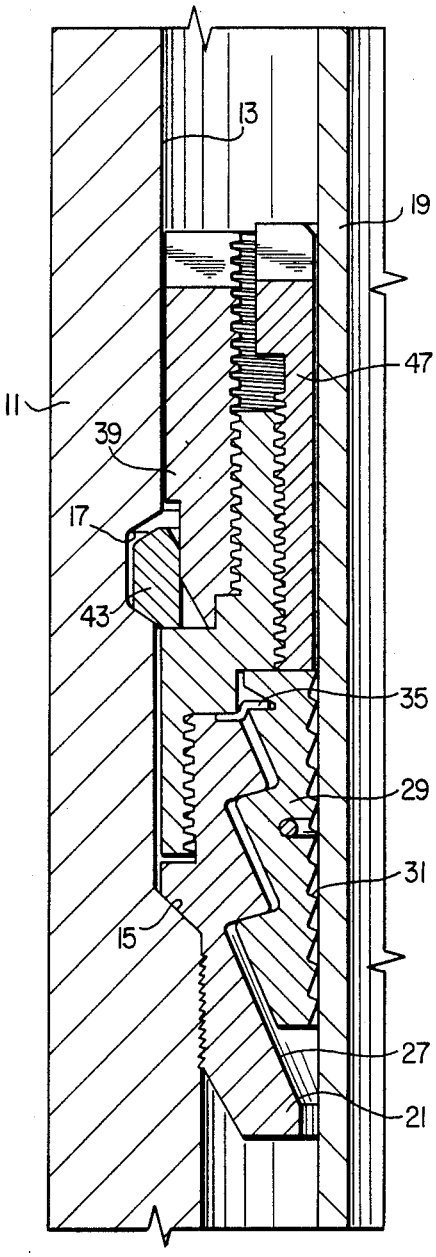
FIG. 3 is a sectional view of the casing hanger of FIG. 1, and shown with the locking ring energized, but with the slips still in the unenergized position.

Then, a running tool is lowered into place and rotated. The running tool first engages the wedge ring 39, because the wedge ring 39 extends upward farther than the energizing ring 47. The wedge ring 39 screws downward, pushing the locking ring 43 outward into the groove 17. This locks the slip body 21 in place. This is the position shown in FIG. 3.

Then, the running tool fingers will engage the energizing ring 47. Rotation of the running tool rotates the energizing ring 47, pushing the slips 29 downward. Normally tension will be applied to the casing 19. The slips 29 will move downward to the position shown in FIG. 1. The spring 35 causes the slips 29 to move downward in unison. Even if one of the slips 29 contacts the casing 19 before another slip 29, the slips will continue to move downward uniformly. The lower ends of the slips 29 will always be in a single plane perpendicular to the axis of the body 21. This uniform movement centralizes the casing 19 within the body 21 and within the wellhead housing 11.

Tension on the casing 19 can be released. The casing 19 may then be cut at the wellhead 11. The packoff 53 is run in place with another running tool. The packoff 53 is lowered to a point on top of the wedge ring 39. The running tool then moves the wedge member 67 downward. This forces the inner face 59 inward into sealing engagement with the casing 19. The tapered inner wall 57*b* causes a significant inward displacement of the inner face 59. The bands 61 deform to seal over pits, rust and other irregularities in the surface of the casing 19. At the same time, the outer face 63 moves outward and embeds into the wickers 65. This causes sealing on the exterior and locks the packoff in place. The running tool then may be retrieved to the surface.

The invention has significant advantages. The emergency slip hanger provides a relatively inexpensive way in which to set casing which has become stuck. The slip hanger centralizes the casing and locks it in place in the wellhead. The packoff will seal against the irregular surfaces on the casing and provide metal-to-metal sealing as well.

While the invention has been shown in only one of its forms, it should be apparent to those skilled in the art that it is not so limited, but is susceptible to various changes without departing from the scope of the invention.

We claim:

1. An apparatus for supporting a string of casing within a conduit which has a landing shoulder, comprising in combination:

a slip body having an exterior shoulder for landing on the landing shoulder, the slip body having at least one inner frusto-conical bowl which is adapted to encircle the casing and which has a longitudinal axis;

slip means carried on the bowl for gripping the casing, the slip means including a plurality of slips, each of the slips having an inner face containing grooves, each of the slips having an upper end located in a plane perpendicular to the axis of the body, each of the slips being movable from an upper retracted position in which the inner face is spaced from the casing to a lower engaged position in which the slip grips the casing;

the body having a tubular upper portion extending upward from the bowl, the upper portion having interior threads;

an energizing ring threaded to the interior threads of the upper portion of the slip body and having a lower end which is in a plane perpendicular to the axis of the body and which engages the upper end of each of the slips;

means for moving the energizing ring downward relative to the slip body by rotating the energizing ring relative to the slip body to move the slips to the engaged position;

means for preventing the slips from moving downward on the slip bowl under the force of gravity and other than by movement of the energizing ring, to assure that each of the slips moves in unison with the other slips as it moves downward, to center the casing in the conduit; and packoff means located above the energizing ring for sealing the casing to the conduit.

2. An apparatus for hanging a string of casing within a conduit which has a landing shoulder, comprising in combination:

a slip body having an exterior shoulder for landing on the landing shoulder, the slip body having at least one inner frusto-conical bowl which is adapted to encircle the casing;

a plurality of slips carried on the bowl, the slips each having an inner face containing grooves for gripping the casing, the slips being movable from an upper retracted position in which the inner faces are spaced from the casing to a lower engaged position in which the slips grip the casing, each of the slips having an outer face containing a slot which extends in a circumferential direction;

means for urging the slips to the retracted position and for preventing the slips from moving downward other than in unison with each other, comprising a flat annular spring having an outer edge fixed to the bowl and an inner edge engaging the slot on the outer face of each of the slips, so that downward movement of the slips causes the spring to deflect downward;

an energizing ring carried by the slip body and having a lower end which engages an upper end of the slips;

means for moving the energizing ring downward relative to the slip body to move the slips to the engages position; and packoff means located above the energizing ring for sealing the casing to the conduit.

3. An apparatus for hanging a string of casing within a conduit which has a landing shoulder, comprising in combination:

a slip body having an exterior shoulder for landing on the landing shoulder, the slip body having at least one inner frusto-conical bowl which is adapted to encircle the casing;

a plurality of slips carried on the bowl, the slips each having an inner face containing grooves for gripping the casing, the slips being movable from an upper retracted position in which the inner faces are spaced from the casing to a lower engaged position in which the slips grip the casing;

an annular spring having an outer edge fixed to the body and an inner edge engaging each of the slips for urging the slips to the retracted position and for preventing the slips from moving downward other than in unison with each other;

an energizing ring carried by the slip body and having a lower end which engages an upper end of the slips;

means for moving the energizing ring downward relative to the slip body to move the slips to the engaged position; and packoff means located above the energizing ring for sealing the casing to the conduit.

4. An apparatus for hanging a string of casing within a conduit which has a landing shoulder, comprising in combination:

a slip body having an exterior shoulder for landing on the landing shoulder, the slip body having at least one inner frusto-conical bowl which is adapted to encircle the casing;

a plurality of slips carried on the bowl, the slips each having an inner face containing grooves for gripping the casing, the slips being movable from an upper retracted position in which the inner faces are spaced from the casing to a lower engaged position in which the slips grip the casing;

means for preventing the slips from moving downward other than in unison with each other;

a groove formed in the conduit above the landing shoulder;

the body having a tubular upper portion extending upward from the bowl, the upper portion having interior and exterior threads;

a split ring carried by the slip body;

a wedge ring threaded to the exterior threads of the upper portion of the body and movable from an upper to a lower position by rotating the wedge ring, the wedge ring having an exterior wedge surface for moving the split ring outward into engagement with the groove to retain the slip body in the conduit when the wedge ring is rotated to the lower position;

an energizing ring threaded to the interior threads of the upper portion of the slip body and movable from an upper position to a lower position by rotating the energizing ring, the energizing ring having a lower end which engages an upper end of the slips to move the slips to the engaged position when the energizing ring is moved to the lower position; and packoff means located above the energizing ring for sealing the casing to the conduit.

5. An apparatus for hanging a string of casing within a conduit, comprising in combination:

hanger means for supporting the casing centrally within the conduit;

an annular metal seal ring having a central annular cavity, the seal ring having an inward facing face adapted to engage the casing and an outward facing face adapted to engage the conduit, the cavity having inner and outer walls, at least one of the walls being tapered over substantially over its entire length;

a plurality of annular bands located on the inner face, the bands being of a metal softer than the casing and being deformable against the casing under sufficient force; and a wedge ring carried by the seal ring, the wedge ring having a lower end which locates within the cavity, the wedge ring being movable from an upper position to a lower position for urging the outer face into sealing engagement with the conduit and the inner face into engagement with the casing with the bands deforming to cause sealing.

6. An apparatus for hanging a string of casing within a conduit, comprising in combination:

hanger means for supporting the casing centrally within the conduit;

an annular metal seal ring having a central annular cavity, the seal ring having an inward facing face adapted to engage the casing and an outward facing face adapted to engage the conduit, the cavity having inner and outer walls, the inner wall being tapered over substantially over its entire length;

the inner face of the seal ring being a cylinder from which a plurality of annular metal bands protrude, the bands being of softer metal than the casing and being deformable against the casing under sufficient force; and a wedge ring carried by the seal ring, the wedge ring having a lower end which locates within the cavity, the wedge ring being movable from an upper position to a lower position for urging the outer face into sealing engagement with the conduit and the inner face into engagement with the casing, with the bands deforming to cause sealing.

* * * * *